US005427232A

United States Patent [19]

Buch

[11] Patent Number: 5,427,232

[45] Date of Patent: Jun. 27, 1995

[54] PACKAGE FOR PRESENTATION AND SALE, PARTICULARLY FOR SMALL ARTICLES, AND PROCEDURE FOR OBTAINING SUCH A PACKAGE

[76] Inventor: Pierre Buch, 33, rue de General Leclerc, 67202 Wolfisheim, France

[21] Appl. No.: 986,109

[22] Filed: Dec. 4, 1992

[30] Foreign Application Priority Data

Dec. 4, 1991 [FR] France ..... 91 15197

[51] Int. Cl.[6] ..... B65D 5/20

[52] U.S. Cl. ..... 206/45.29; 206/472

[58] Field of Search ..... 206/472–475, 206/450, 424, 491, 45.29, 45.21

[56] References Cited

U.S. PATENT DOCUMENTS

| | | | |
|---|---|---|---|
| 2,387,790 | 10/1945 | Williamson | 206/472 |
| 2,603,405 | 7/1952 | Frankenstein | 206/472 X |
| 3,541,599 | 7/1969 | Ramshaw et al. | 206/472 |
| 4,413,726 | 11/1983 | Davidson | 206/45.29 |
| 4,635,797 | 1/1987 | Bankier | 206/472 |
| 4,966,283 | 10/1990 | Sykes et al. | 206/472 |
| 5,007,530 | 4/1991 | Weismantel | 206/45.21 |
| 5,193,681 | 3/1993 | Lievsay | 206/472 |

FOREIGN PATENT DOCUMENTS

| | | | |
|---|---|---|---|
| 2307707 | 11/1976 | France | 206/424 |

*Primary Examiner*—Jacob K. Ackun
*Attorney, Agent, or Firm*—Lerner, David, Littenberg, Krumholz & Mentlik

[57] ABSTRACT

The present invention relates to a package for presentation and sale, particularly for small articles, and also to a procedure for obtaining such a package. The package of the present invention assumes the form of a book having a flange, manufactured from a single component and having two portions, one of which forms a container, the other of which forms a lid, with the portions being connected to one another by a spine, characterized by the fact that the container includes an inner surface surrounded by four lateral walls, and by the fact that the lid is fitted with an internal portion intended to receive a label or marking, with the entirety of the package being manufactured from a single blank of material which is cut out and which includes fold lines which are imprinted by means of grooving or rabbeting.

13 Claims, 7 Drawing Sheets

PACKAGE FOR PRESENTATION AND SALE, PARTICULARLY FOR SMALL ARTICLES, AND PROCEDURE FOR OBTAINING SUCH A PACKAGE

The present invention relates to the field of packages, and particularly the field of packages for presentation and for sale, and has as its object a package intended for said purpose. The invention also has as an object a procedure for obtaining such a package.

At the present time, the presentation and the sale of certain articles, and particularly of small articles, notably jewelry, are generally achieved by means of rigid packages, which in most instances are made of a synthetic material.

Granted, such known packages respond very satisfactorily to the needs of users, particularly with regard to the development of such products and their possible protection against shock. However, such packages have the disadvantage of requiring a large amount of storage space.

Furthermore, inasmuch as such packages are intended to be used only once, the problem of waste disposal arises. This problem is exacerbated by the fact that such packages are not biodegradable.

In order to remedy this disadvantage, multiple-use packaging boxes been proposed, in particular in the form of a book having a flange. In such a case, the packaging box is made from a single part and has two essentially identical portions, one of which forms the container and the other of which forms the lid, with said portions being connected to one another by means of a spine.

Nevertheless, each part has only one frontal surface and two lateral surfaces, with the back surface being common to both parts and being formed by said spine. The box thus obtained is held closed by means of a locking system consisting of the cooperation of at least one slot in the lid and at least one tab provided in the container.

Furthermore, such a box does not consist of a receptacle which is closed on the four sides, in order to receive an article, not an internal surface which is sufficient to receive a significant inscription with regard to the said article. Moreover, in this form, such a box has a dorsal portion which is highly fragile and easily crushed. The addition of a receptacle could be envisioned in order to improve the presentation and the holding of the article in the package. Such an addition would however make the manufacturing procedure more complicated, and, correlatively, involve a significant increase in production costs.

The goal of the present invention is to remedy these disadvantages.

In effect, the object of the invention is a package for presentation and sale, particularly for small articles, created essentially in the form of a book having a flange, manufactured from a single component and having two portions, one of which forms the container and the other of which forms the rid, with said portions being connected to one another by a spine, characterized by the fact that said container includes a receptacle having four lateral walls, and by the fact that said lid is fitted with an internal portion intended to receive a label or marking, with the entirety of said package being manufactured from a single blank of material which is cut out and which includes fold Lines which are imprinted by means of grooving or rabbeting.

Another object of the invention is a procedure for obtaining such a package, characterized by the tact that said procedure consists essentially of first cutting out, by means of stamping of a material in sheet form, a blank having all of the constituent parts of said package, and then of printing fold lines, by means of the simultaneous grooving or rabbeting of said parts, and then of creating the volume for said package by means of said stamped and grooved or rabbeted blank, by means of a first series of folding and gluing of the constituent parts of said container and of said lid in order to obtain a flat package, and then creating the definitive volume by assembling the entire package without gluing.

The invention will be better understood through reference to the following description, which relates to a preferred embodiment of the invention, given as a non-limitative example, and explained with reference to the attached schematic drawings, on which:

FIGS. 13 and 14 are perspective views representing the final assembly of the package;

DETAILED DESCRIPTION OF THE PREFERRED EMBODIMENTS

Figure 1:
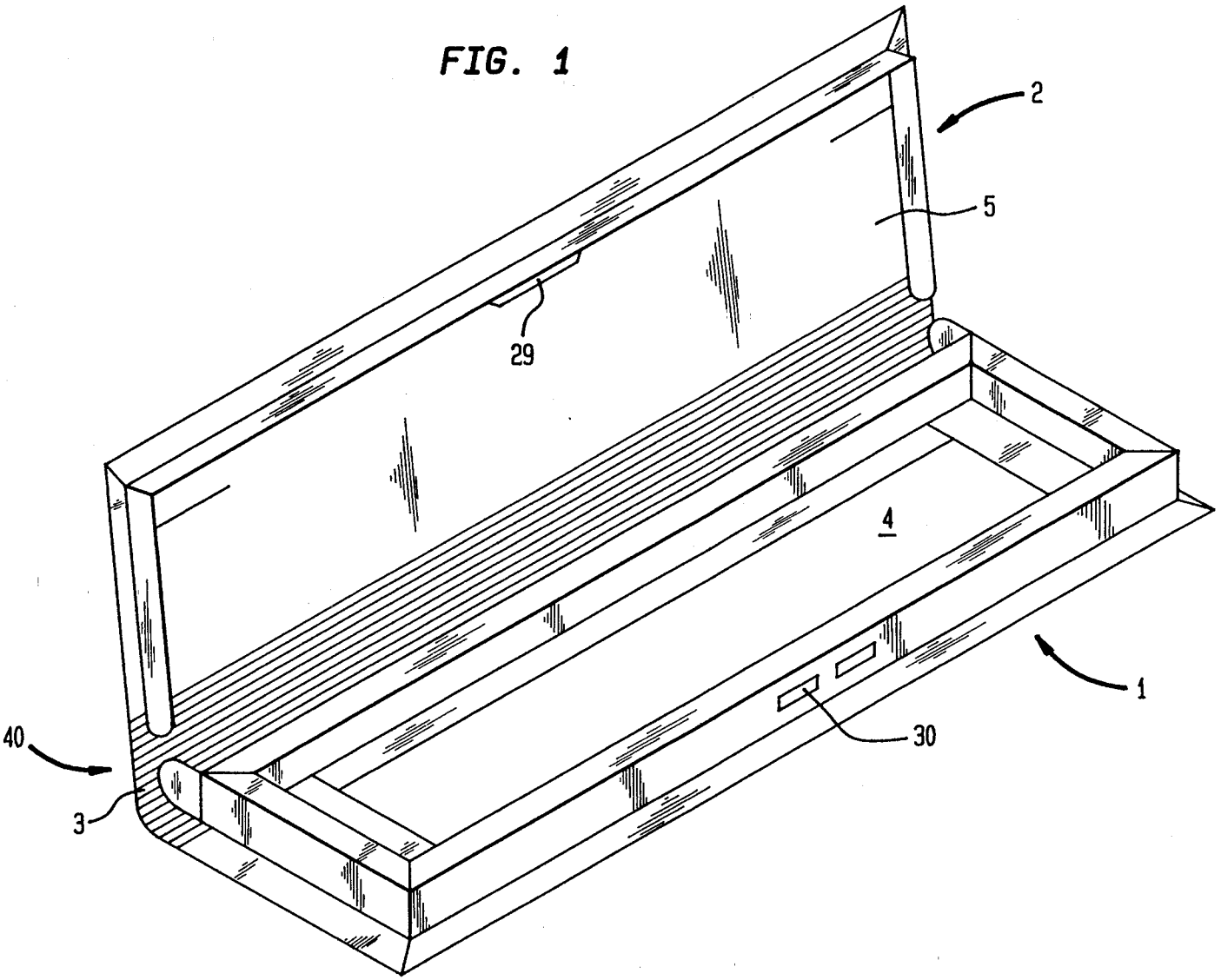
FIG. 1 is a perspective view of a package in accordance with the invention, in position with its lid raised.

In accordance with the invention and as indicated more particularly in FIG. 1 of the attached drawings, the package 40 for presentation and sale, particularly for small articles, created essentially in the form of a book having a flange, manufactured from a single component, and having two portions, one of which forms a container generally designated 1 and the other of which forms a lid generally designated 2, with said portions being connected to one another by a spine 3, is characterized by the fact that said container 1 includes an inner surface 4 surrounded by four lateral walls, and by the fact that said lid 2 is fitted with an internal portion 5 intended to receive a label or marking, with the entirety of said package 40 being manufactured from a single blank of material which is cut out and which includes fold lines which are imprinted by means of grooving or rabbeting.

As indicated by FIGS. 2–14, the package 40 is manufactured by first stamping a blank out of a sheet of material wherein the blank includes all of the constituent parts of the package 40. A plurality of fold lines are then created by simultaneously grooving or rabbeting the parts of the package 40. Thereafter, the volume of the package 40 is created by performing a first series of folding and gluing operations to the constituent parts of the container 1 and of the lid 2 so that a flat package is formed, and then creating the definitive volume by assembling the entire package 40 without gluing.

For said purpose the blank intended to form said package 40 is obtained by stamping a sheet of material in a manner so that the blank is cut out therefrom. A series of large individual surfaces 1', 2', 4 and 5 are formed during the step of stamping the sheet material. The surfaces 1' and 4 correspond respectively to the external and the internal surfaces of the container 1. The surfaces 2' and 5 correspond respectively to the external and internal surfaces of the lid 2. Additionally, the surfaces 1' and 2' are both connected to the spine 3 which is arranged therebetween. The surfaces 1' and 4 are connected by two walls 6 and 7. A longitudinal separation strip 8 is interposed between the surface 1' and the wall 6. Additionally, a longitudinal separation strip 9 is interposed between the walls 6 and 7. The surface 2' is connected to the surface 5 by two walls 11 and 12. A longitudinal gluing strip 10 is interposed between the surface 2' and the wall 11. Secondary walls 7' and 6' are connected to the surface 4 on the opposite side from wall 6 and 7. In this regard, secondary walls 7' and 6' are connected to each other by a secondary separation strip 9'. Thus, one side of the secondary wall 6' is connected to the secondary separation strip 9' and the other side of the wall 6' is connected to a gluing tab 22. The surfaces 1' and 2' are furthermore provided, at the transverse extremities, respectively, with surface 1' of said external wall 13 and said internal wall 14, with said surface 1' being connected to said walls 13 by means of gluing strips 15 and to said walls 14 by means of separation strips 16, and with the locking tabs 17, and with said surface 2' of external wall 18 and internal wall 19 being connected to one another at their adjacent edges, with said walls 18 being connected at the outer edge to the surface 2' by means of gluing strips 20, and with said walls 19 being provided externally with locking tabs 21, with said various elements having fold lines at that point of junction with said neighboring elements.

The surfaces 1' and 2', along with the spine 3, are identical in length. The gluing strips 8 and 10, which are linked respectively to the walls 6 and 11, have oblique extremities. The sides which are in contact with the wall 6 and 11 have a length which is less than that of the surfaces 1' and 2'. The wall 12, which is connected to the wall 11 is slightly shorter than the wall 11, and has at each end a slight flexure with regard to the extremities of the wall 11, whereas the surface 5 is of a length which is identical to that of the wall 12.

Figure 2:
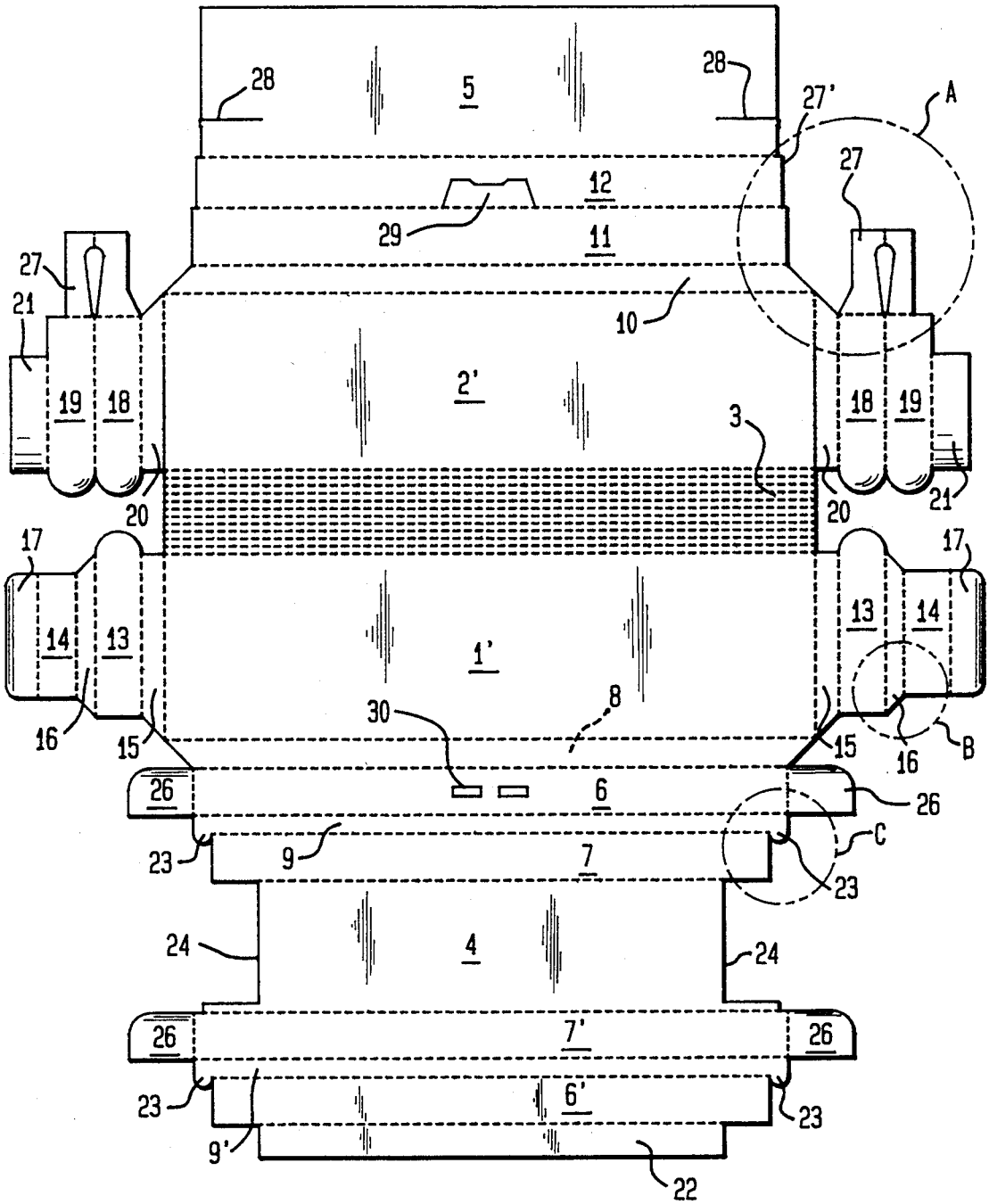
FIG. 2 is a plan view of the blank which is used to manufacture said package.
Figure 3:
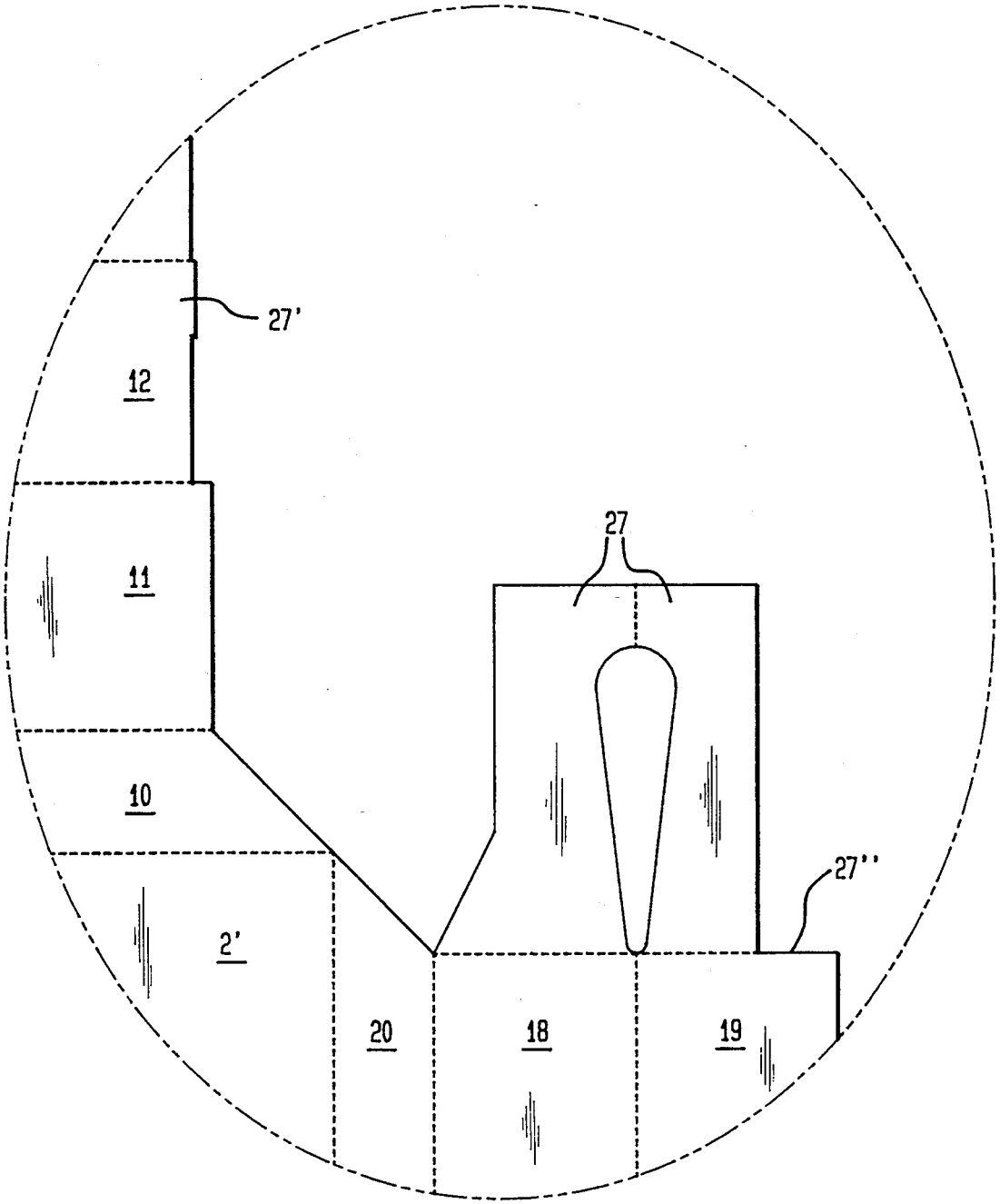
FIG. 3 is a partial plan view, at a larger scale, of Detail A in FIG. 2.
Figure 4:
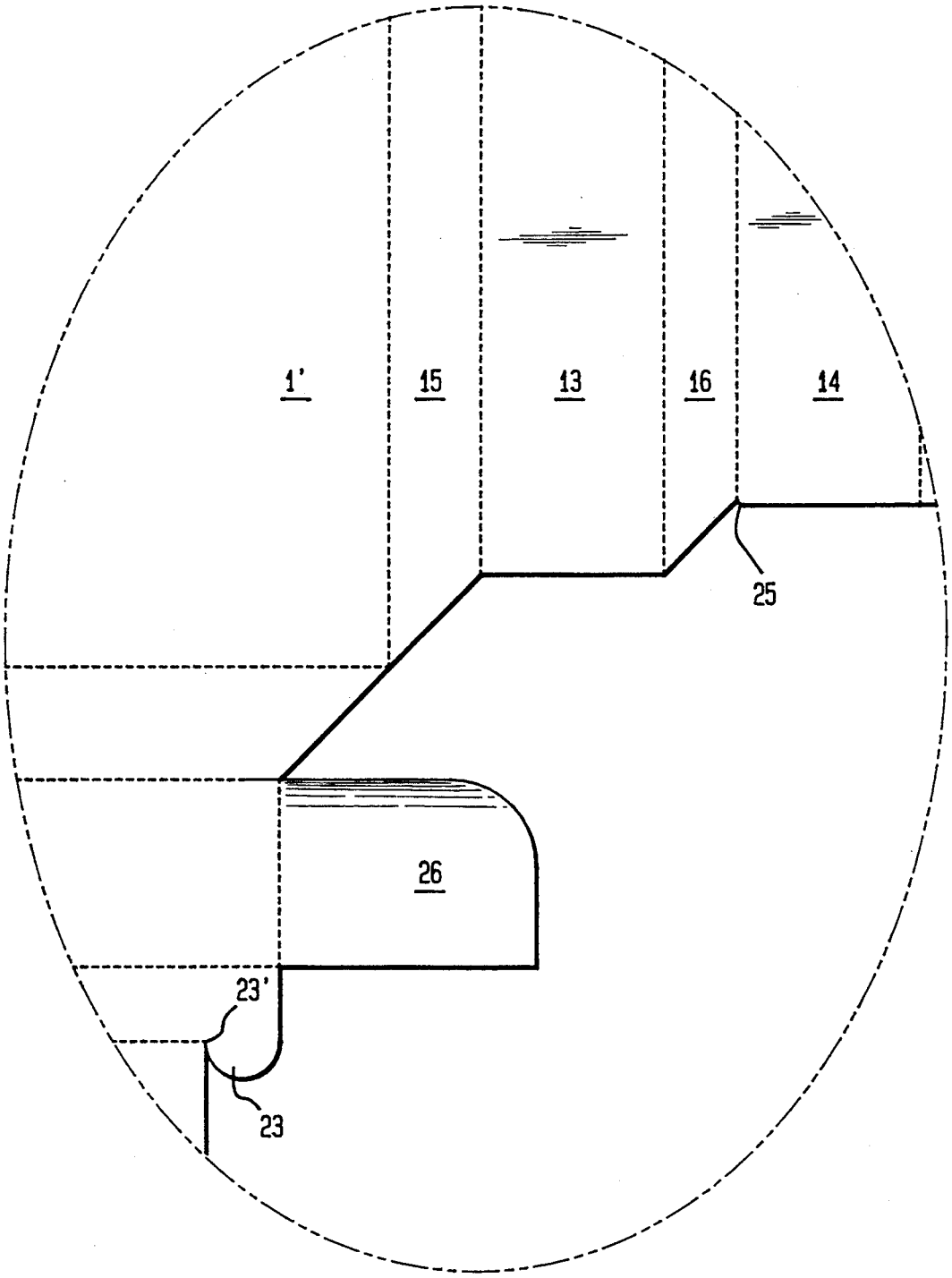
FIG. 4 is a view, analogous to the view in FIG. 3, of Detail B and Detail C in FIG. 2.
Figure 5:
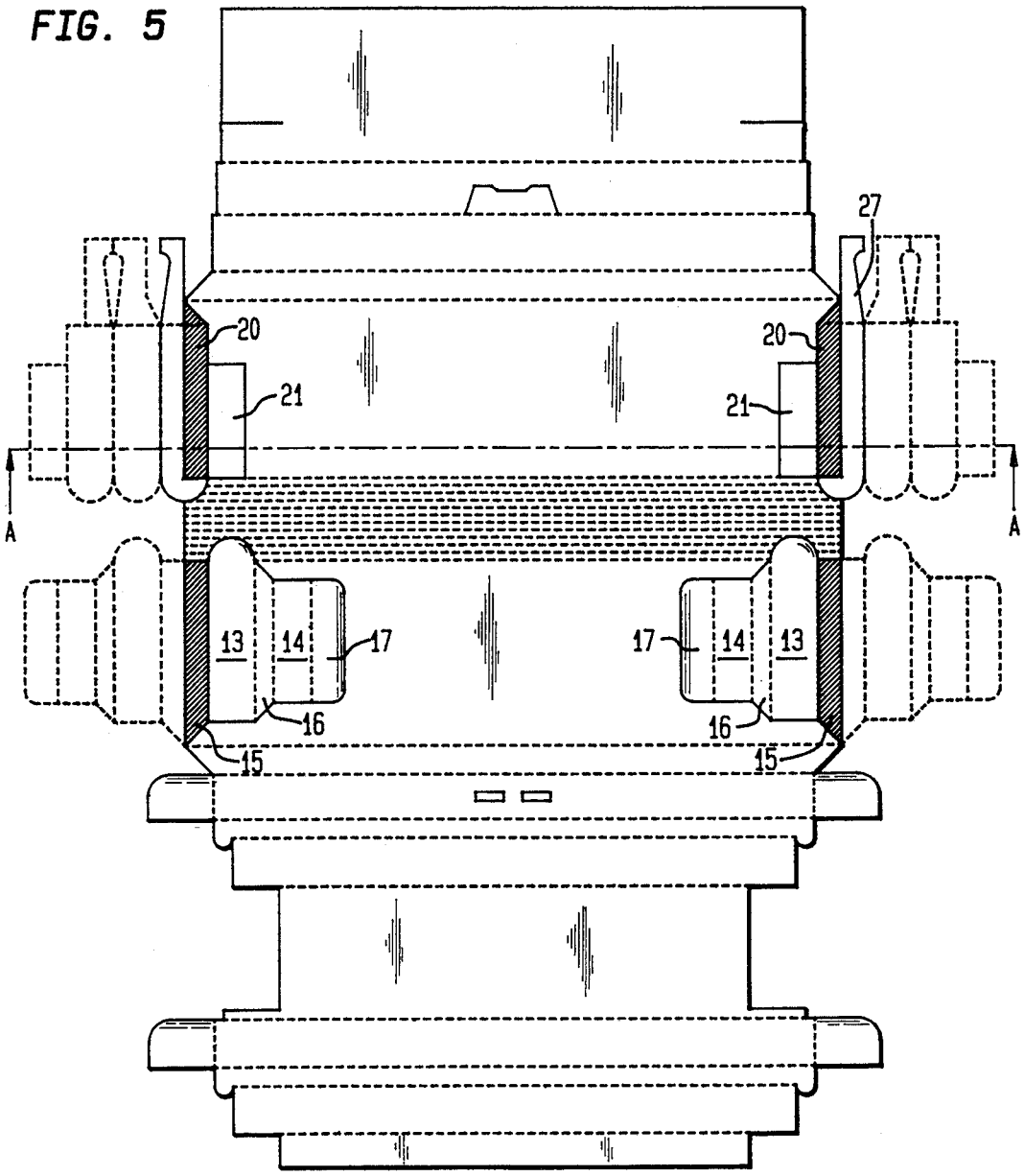
FIG. 5 is a view which is analogous to the view in FIG. 2, representing the blank after a first series of folds and gluing.

Said wall 7 is shorter than said wall 6, and said separation strip 9, which at both ends is longer than the ends of said wall 7, has at its ends outwardly extending elements 23 which, at the point of junction with said wall 7, are extended by means of a notch or kerf 23' which penetrates into said strip 9 (see Detail C in FIG. 2 and FIG. 4).

Said wall 7', which is connected to said wall 6' by means of a strip 9', is longer than said wall 6', and said strip 9' is identical to said strip 9. Said gluing tab 22 is clearly shorter than said wall 6' and corresponds to the length of said surface 4, which at its ends is fitted with two transverse cut-outs 24.

Said walls 13 are connected to each end of said surface 1' by means of gluing strips 15, of which one end is in alignment with said first fold line of said spine 3, whereas the other ends extends obliquely into alignment with the ends of said gluing strip 8. The corresponding end of said wall 13 extends in the longitudinal direction of said surface 1', whereas its opposite end has a rounded portion whose radius is essentially equal to that of said spine 3. Said wall 14 and said locking tab 17 are of equal length, but are shorter than said wall 13 to which said wall 14 is connected by means of said strip 16, whose ends are oblique.

At the location of the join between said separation strip 16 and said wall 14, a notch or kerf 25, which is intended to cooperate with said outwardly extending elements 23 of said strips 9 and 9', is provided at each end of said fold line. (See Detail B in FIG. 2 and FIG. 4).

Furthermore, said walls 6 and 7' are provided at their extremity with flaps 26 intended to cooperate with said walls 13 and with said separation strips 16 when said package is assembled, with said locking tabs 17 then pressing against said cut-out portions 24.

Each wall 18 is connected to one extremity of said surface 2 by means of a strip 20 which is analogous to said linking strip 15 of said wall 13 and which has, on its side oriented toward said spine 3, a rounded portion corresponding to that of said spine 3 and, at its opposite end, a hook-shaped portion 27 which is connected by means of its point to that of a corresponding hook-shaped portion 27 which is integral to said corresponding extremity of said wall 19, whose other extremity also has a rounded portion. Said hook-shaped portion 27 affixed to said wall 19 is cut out at said point of junction, with said cut-out 27'' encroaching on said wall 19 and creating in said wall an edge which, in its working position, cooperates with a slight outwardly extending portion 27' of said ends of said wall 12. Said locking tabs 21 in their working position extend under said surface 5 forming the internal portion of said lid 2. (See Detail A in FIG. 2 and FIG. 3).

In a variant of the embodiment of the invention, said walls 18 and 19 are each provided, instead of with portions 27, with a tab, with said tabs being connected to one another at the point of junction between said walls.

The creation of volume for the package in accordance with the invention, starting from the above-mentioned stamped blank, is advantageously achieved in two main stages, namely, a stage consisting of folding and gluing, and an assembly stage.

Figure 6:
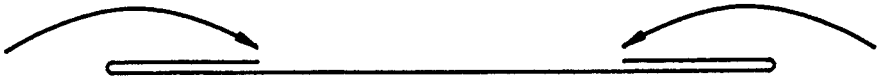
FIGS. 6 through 8 are cross-sectional views along line A—A in FIGS. 5, representing the series of folding and gluing operations performed.
Figure 7:
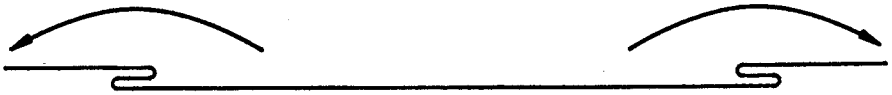
Figure 8:
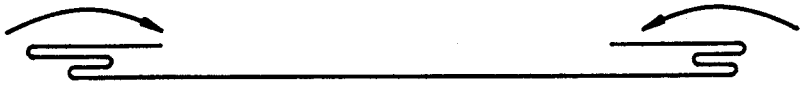
Figure 9:
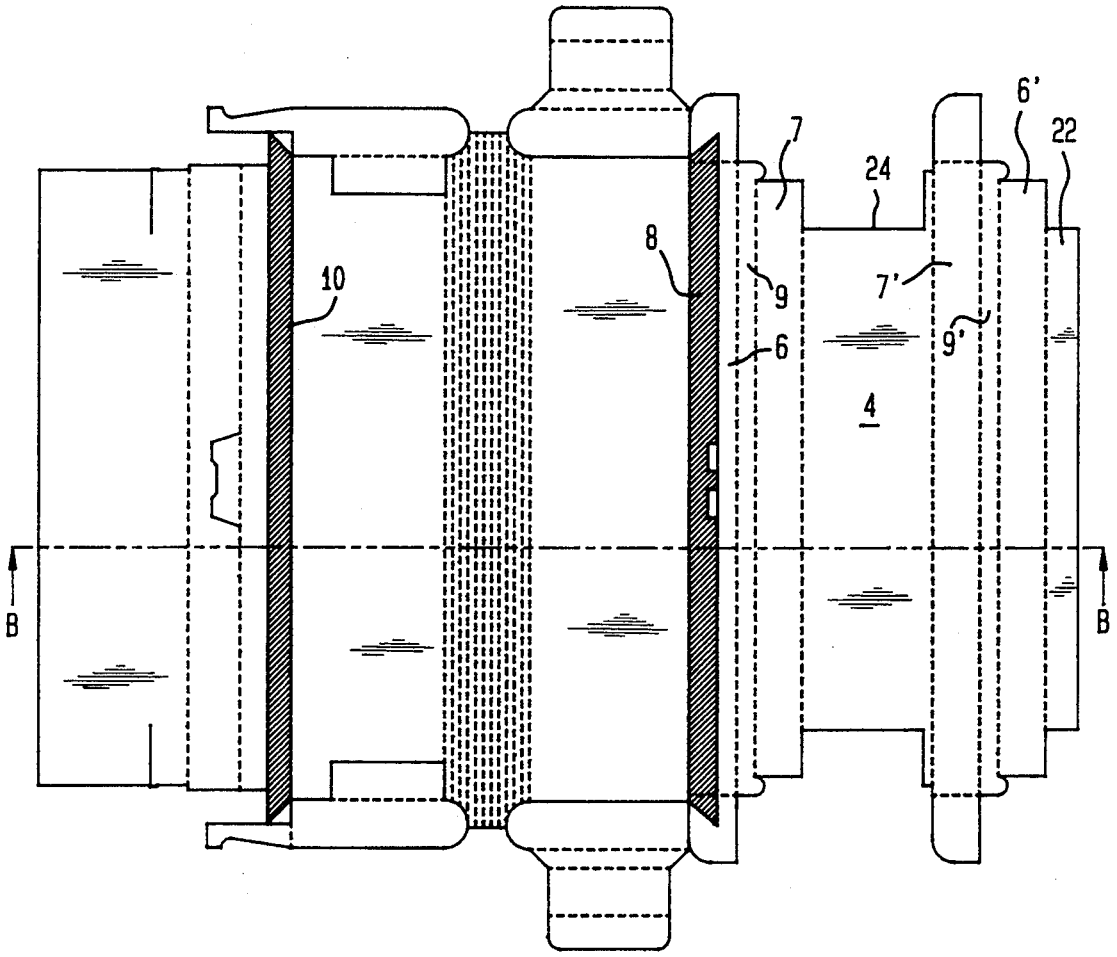
FIG. 9 is a view which is analogous to the view in FIG. 5, representing the blank after a second series of folds and gluing oriented transversely with regard to said first series of folds and gluing.

Said folds and gluing can be achieved in a known manner, by means of two successive passes through a folding and gluing machine, with a first pass being achieved in the longitudinal direction, as more particularly shown in FIGS. 5 through 8, in order to achieve the folding and gluing of said strips 20 and of said walls 18 and 19, along with the gluing of said strips 15. FIGS. 6 through 8 more particularly show the set of operations performed for the folding and gluing of said strips 20 and said walls 18 and 19.

Figure 10:
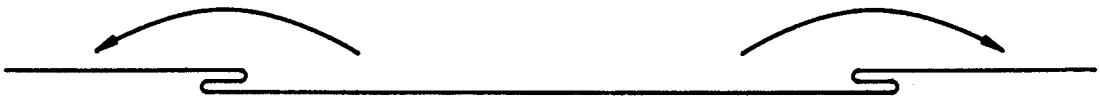
FIGS. 10 through 12 are cross-sectional views along line B—B in FIG. 9, representing the series of folding and gluing operations performed.
Figure 11:
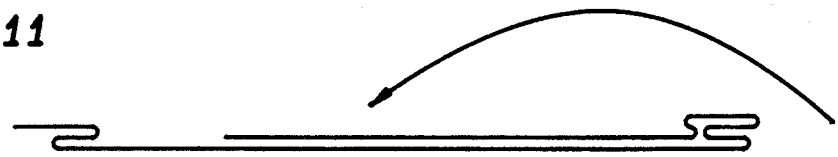
Figure 12:
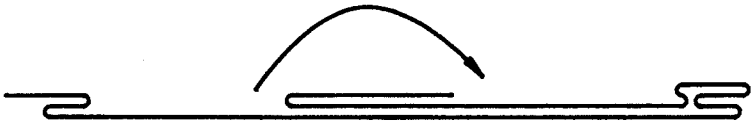
Figure 14:
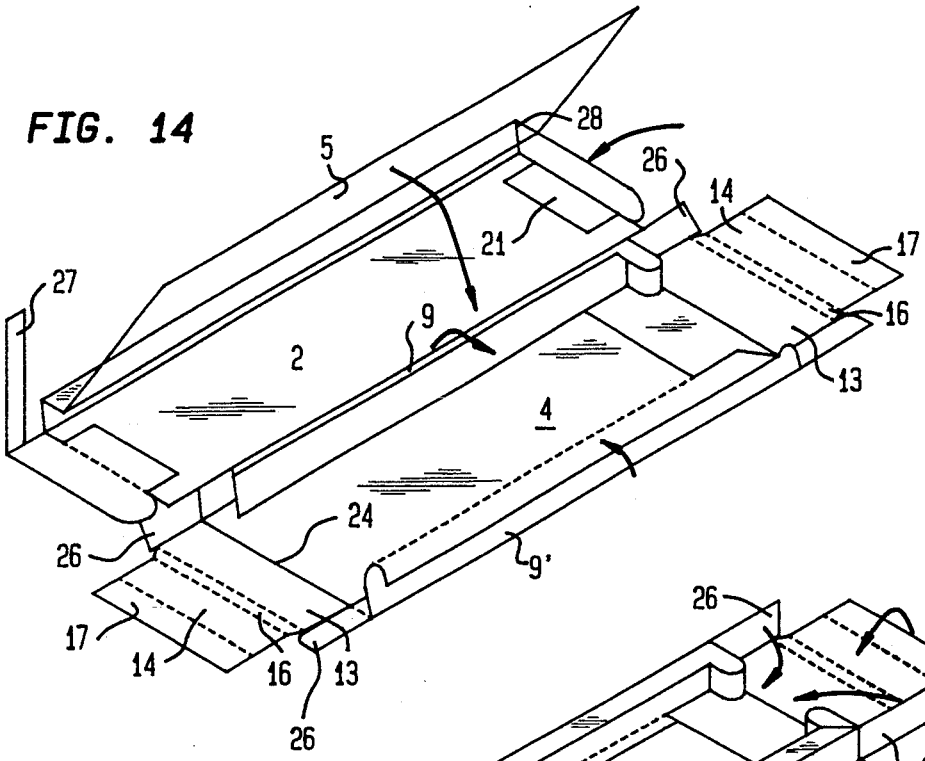

A second pass is then performed in a transverse direction, as shown in FIGS. 9 through 12 of the attached drawings, in order to achieve the folding and gluing of said strip 10 and of said longitudinal edges of said container 1 by means of gluing, first of said strip 9, followed by folding, toward the side opposite said spine 3, of said wall 6 at its point of junction with said strip 8, and then by folding of said surface 4 along the edge of said wall 7, and gluing of said surface 4 to said surface 1', with another fold then being made between said wall 7' and said strip 9', followed by gluing of said strip 22 on the inside of said surface 4. These various operations are shown in FIGS. 10 through 12.

Thus, a package is obtained in the form of a flat box to which volume can be added by means of simple assembly, without gluing, either manually or by means of a machine. Said assembly is achieved in two stages, in any order.

Said container 1 is realized by raising said rear walls 6' and 7' and said front walls 6 and 7, followed by an inward folding of said flaps 26 of said walls 6 and 7'. Said side walls 13 and 14 are then put into place, in order to ensure that said walls 6', 7' and 6 and 7 will be held in position, by means of cooperation with said flaps 26, against which said walls 13 are locked, with said strips 16 butting against the upper edges of said strips 9 and 9'. Said walls 14 are folded down in order to form the internal structure of the side walls, and are then held locked in a position parallel to said walls 13 by said locking tabs 17, which are lodged within said cut-out portions 24 of said surface 4, thereby forming the bottom of said container 1 (see FIG. 13 and FIG. 14).

The assembly of said lid 2 (see FIG. 13) is achieved by a first folding of said hook-shaped parts 27 ninety degrees inwardly, then by straightening up of said wall groups 18 and 19. Then, said wall 11 is straightened and said wall 12 is folded down toward the interior, to butt against said wall 11 and be held by said hooks 27, in such a way as to hold said walls 18 and 19 in a vertical position.

In order to allow locking into position of said wall 12, and thereby of said surface 5, said surface 5 is provided at its two lateral edges with a locking slot 28 which is intended to cooperate with the corresponding edges of said locking tabs 21. Thus, by folding down said surface 5 against said inner side of said surface 2', said wall 12 is held against said wall 11 and said surface 5 remains butted against said surface 2'.

Said holding pressure is reinforced by the locking of said outwardly extending portions 27', as provided at the extremities of said wall 12, against said cut-out portion 27''.

Assembly is then concluded, and the package 40 can be closed by folding down said lid 2 over said container 1. For said purpose, said spine 3, which is advantageously provided with multiple grooving, allows the package to be closed easily. Holding pressure of said lid 2 in said container 1 is obtained, in accordance with any known method, by means of a locking tab 29 provided in said wall 12 and cooperating with one or more slots 30 provided in said wall 6. Such an embodiment allows repeated openings and closings.

The package 40 in accordance with the invention is described in relation to a box having a linking spine between said container 1 and said lid 2. The lid 2 may have a rounded configuration. However, said lid can also have any other shape, with the lateral portions of the walls in such an instance having a corresponding shape, and with said multiple grooving then being limited to the grooving which is necessary for said other shape.

Figure 17:
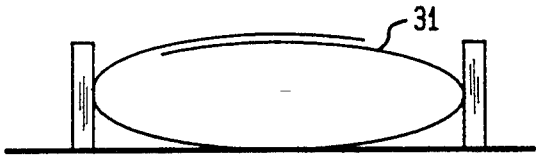
FIG. 17 is a cross-sectional view along line C—C in FIG. 14, representing the package in its normal working position.

In accordance with another characteristic of the invention, and as shown in FIG. 17 on the attached drawings, said container 1 can be provided with a sheet 31 of rolled paper arranged on the internal surface 4, said sheet consisting of tissue paper or some other type of paper, intended to receive printing, such as a trademark or some other mark. Such a sheet 31 makes it possible to improve the interior aesthetic appearance of the package 40, such as for example in order to form a jewel-casket.

In accordance with another characteristic of the invention, said inner surface 5 of said lid 2 is advantageously connected to said wall 12, in a detachable manner, with the fold line between said wall 12 and said inner surface 5 being in the form of a removable strip. Thus, said surface 5 can present itself, for example, in the form of a detachable card which can carry an inscription, such as for example in the form of a guarantee coupon.

Figure 15:
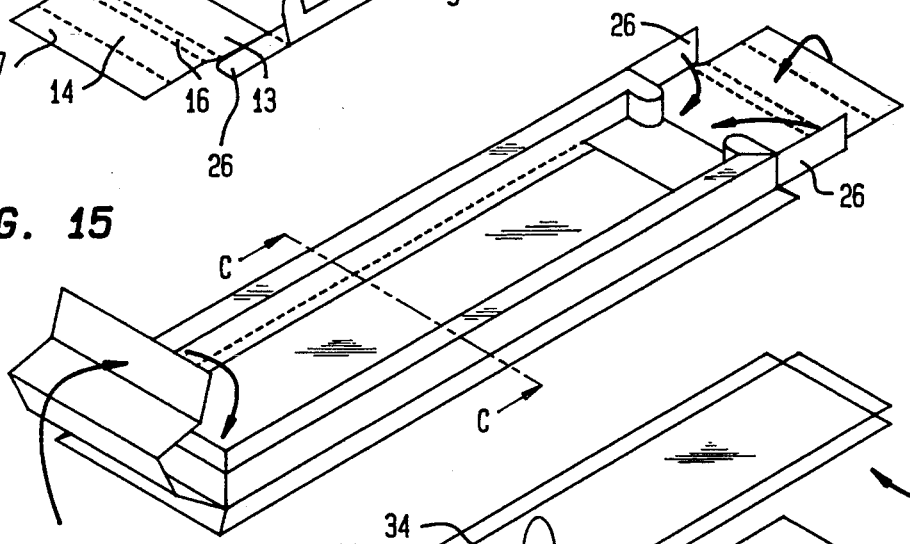
FIGS. 15 and 16 are perspective views of an adapter which can be incorporated into the receptacle.
Figure 16:
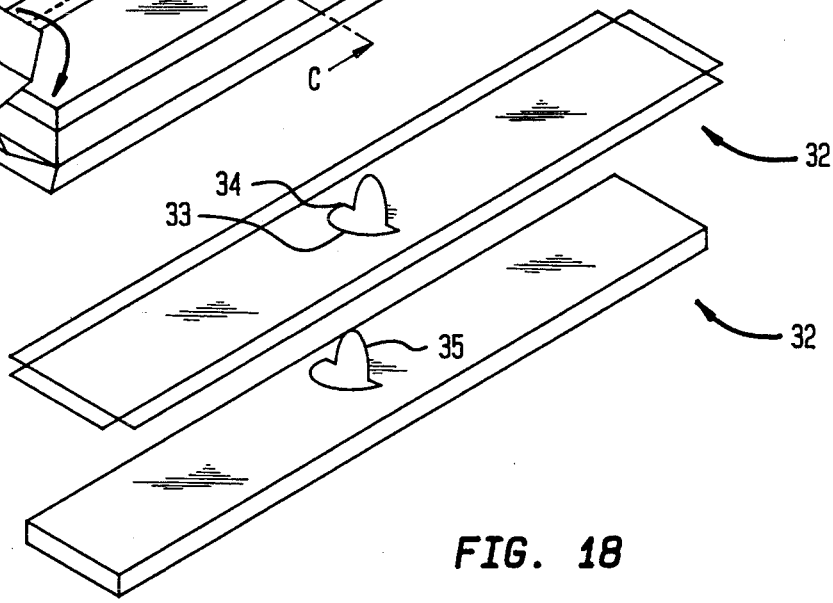
Figure 18:
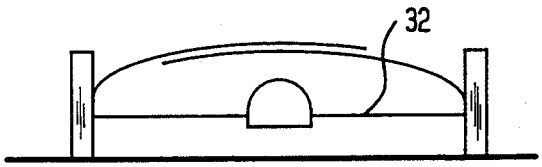
FIG. 18 is a view which is analogous to the view in FIG. 17, representing the package with an adapter in accordance with FIG. 15 and FIG. 16.

FIGS. 15, 16 and 18 represent a variant of an embodiment of the invention in which said container 1 is provided with an adapter 32 in the form of an inverted box formed by a stamped flat part provided with four foldable edges, with said part being capable of being fitted, as its central surface, with two stamped holes 33 which are connected to one another by means of a rounded slot 34 in which an elastic or non-elastic holding device 35 can be placed. Such an adapter 32 is more particularly intended to be applied by means of light pressure at the bottom of a package, in order to receive a small object with long "legs" or a small object having some other aspect ratio.

Thanks to the invention, it is possible to realize a package 40 having a container 1 with four lateral walls surrounding an internal surface 4, along with lid 2 having an internal surface intended to receive a mark or an impression. The four walls of said container 1 make it possible to avoid the facility of the dorsal portion and to improve the aesthetic appearance of the package 40, while said internal surface 5 makes it possible to achieve a noticeable improvement in the aesthetic appearance of the interior of said lid 2, by hiding the locking structures of said lateral walls.

Such a package 40 can be made of any flexible and pliable material, for instance, cardboard or a synthetic or non-synthetic material.

Of course, the invention is not limited to the embodiment described herein and represented on the attached drawings. Modifications are possible, particularly in relation to the constitution of the various elements or by substitution of equivalent techniques, without in any way departing from the protected domain of the invention.

I claim:

1. A display package comprising:

a one-piece blank including a plurality of fold lines, said one-piece blank being adapted to be folded along said plurality of fold lines to form various portions including a spine portion medially arranged on said one-piece blank and being adapted to form a hinge for the display package, said spine portion having a predetermined length and width and being flexible along said entire width; a receptacle portion connected to said spine portion at a first side of said width and including four lateral walls arranged to define a first central section therebetween, said first central section adapted to retain articles thereon; and a lid portion connected to said spine portion at a second side of said width opposing said connection to said receptacle portion, said lid portion including a second central portion and being operatively connected to said receptacle portion by said flexible spine portion for relative movement therebetween so that the display package can be selectively positioned into an opened or closed configuration, said second central section of said lid portion including a perimeter, said lid portion comprising three walls arranged at said perimeter, none of said walls extending along the portion of said perimeter adjacent said spine portion, said lid portion further comprising an internal portion detachably connected to at least one of said three walls for selective removal therefrom, said internal portion being adapted to receive promotional writing thereon.

2. The display package of claim 1, wherein said spine portion includes a plurality of longitudinal grooves arranged along said predetermined length thereof to facilitate movement between said lid portion and said receptacle portion during said selective opening and closing of the display package.

3. The display package of claim 1, wherein said spine portion comprises a single wall section of said one-piece blank.

4. The display package of claim 1, wherein said lid portion includes at least one tab extending inwardly from a selected one of said three walls opposing said spine portion, and said receptacle portion including at least one slot arranged in a selected one of said four lateral walls and being adapted to receive said at least one tab so that said lid portion can be selectively secured to said receptacle portion when it is desired to maintain said display package in a closed configuration.

5. The display package of claim 1, further comprising appearance enhancing means for creating an enhanced aesthetic appearance within said receptacle portion, said appearance enhancing means being arranged on said first central section of said receptacle portion.

6. The display package of claim 5, wherein said appearance enhancing means comprises a sheet of rolled paper adapted to receive printed writing thereon.

7. The display package of claim 1, wherein said one-piece blank comprises four relatively large surface areas between said plurality of fold lines, and a plurality of separation strips having relatively small surface areas thereon, said spine portion being arranged between two of said relatively large surface areas and said plurality of separation strips, said plurality of separation strips being arranged between said two of said relatively large surface areas separated by said spine portion and respective ones of the other two of said relatively large surface areas.

8. The display package of claim 1, further comprising supplemental support means having an upper surface and a lower surface arranged on said first central section of said receptacle portion for supporting articles on said upper surface thereof, said supplemental support means having a cut-out portion extending between said upper surface and said lower surface, and holding means arranged within the cut-out portion for retaining the articles on said upper surface of said supplemental support means.

9. The display package of claim 8 said cut-out portion comprises a pair of spaced circular apertures and an elongate arcuate passageway extending therebetween, said holding means comprising an elastic loop arranged within said pair of spaced circular apertures and extending both above said upper surface and below said lower surface so that a selected one of the articles can be retained between said elastic loop and said upper surface of said supplemental support means.

10. A display package comprising:

a one-piece blank including a plurality of fold lines, said one-piece blank being adapted to be folded along said plurality of fold lines to form various portions of the display package, said one-piece blank including four relatively large surface areas between said plurality of fold lines, and a plurality of separation strips having relatively small surface areas thereon, said various portions including a spine portion medially arranged on said one-piece blank and being adapted to form a hinge for the display package, said spine portion having a predetermined length and width and being flexible along said entire width, said spine portion being arranged between two of said relatively large surface areas, said plurality of separation strips bring arranged between said two relatively large surface areas separated by said spine portion and respective ones of the other two of said relatively large surface areas, said two relatively large surface areas connected to said spine have a predetermined length greater than the length of the other two of said relatively large surface areas, and a plurality of gluing strips interposed between selected ones of said relatively large surface areas and selected ones of said plurality of separation strips; a receptacle portion connected to said spine portion at a first side of said width and including four lateral walls arranged to define a first central section therebetween, said first central section adapted to retain articles thereon; and a lid portion connected to said spine portion at a second side of said width opposing said connection to said receptacle portion, said lid portion including a second central portion and being operatively connected to said receptacle portion by said flexible spine portion for relative movement therebetween so that the display package can be selectively positioned into an opened or closed configuration.

11. The display package of claim 10, wherein said one-piece blank further comprises a plurality of locking tabs, said locking tabs being connected to the two relatively large surface areas having lengths greater than the other two relatively large surface areas.

12. The display package of claim 11, further comprising a plurality of locking tab gluing strips arranged between said locking tabs and said two relatively large surface areas.

13. The display package of claim 11, wherein at least one of said relatively large surface areas includes locking slot means for permitting the corresponding one of said plurality of relatively large surface areas to become engaged with corresponding ones of said plurality of locking tabs.

* * * * *